United States Patent [19]

Masuda et al.

[11] Patent Number: 4,489,225

[45] Date of Patent: Dec. 18, 1984

[54] ELECTROMAGNETIC CONTACTOR

[75] Inventors: Shigeru Masuda; Hiroyuki Okado, both of Nagoya; Teijiro Mori, Amagasaki, all of Japan

[73] Assignee: Mitsubishi Denki Kabushiki Kaisha, Tokyo, Japan

[21] Appl. No.: 404,923

[22] Filed: Aug. 3, 1982

[30] Foreign Application Priority Data

Aug. 13, 1981 [JP] Japan ..... 56-120449[U]
Aug. 20, 1981 [JP] Japan ..... 56-123369[U]

[51] Int. Cl.[3] ..... H01H 33/08; H01H 33/10
[52] U.S. Cl. ..... 200/144 R; 200/147 R
[58] Field of Search ..... 200/144 R, 147 R

[56] References Cited

U.S. PATENT DOCUMENTS 4,080,520 3/1978 Muller ..... 200/144 R
4,237,355 12/1980 Fechant et al. .

FOREIGN PATENT DOCUMENTS 1051935 3/1959 Fed. Rep. of Germany ... 200/144 R
1922747 11/1970 Fed. Rep. of Germany ... 200/144 R
224177 1/1969 Switzerland ..... 200/147 R
1068436 5/1967 United Kingdom ..... 200/144 R

*Primary Examiner*—Robert S. Macon
*Attorney, Agent, or Firm*—Oblon, Fisher, Spivak, McClelland & Maier

[57] ABSTRACT

An electromagnetic contactor comprises a stationary contact point fixed to a stationary contact, a movable contact point fixed to a movable contact to associate with the stationary contact point for switching operations, an arc box for arc extinction for receiving the stationary and movable contacts, a commutation plate fixed to the arc box to commutate arc produced between the stationary and movable contacts and grids placed adjacent to the commutation plate and each having fitting pawls to be inserted into slits formed in the arc box, the top end of said fitting pawls being bent at the portion projecting from the slit to fix the grid to the arc box. The shortest distance X between the commutation plate and the stationary contact and the shortest distance Y between the grid and the stationary contact have relation of $X \leqq Y$.

15 Claims, 8 Drawing Figures

ELECTROMAGNETIC CONTACTOR

BACKGROUND OF THE INVENTION

1. FIELD OF THE INVENTION

The present invention relates to an electromagnetic contactor. More particularly, it relates to an electromagnetic contactor for turning-on and off an electric device such as a motor.

2. DESCRIPTION OF THE PRIOR ART

The structure of the typical electromagnetic contactor will be described with reference to FIGS. 1 and 2. The electromagnetic contactor generally comprises a base (10), an arc box (12) and a fitting plate (14) for fitting the contactor to the control panel of an electric apparatus.

The base (10) is made of an insulating material in shape of a box and holds a cross bar (16) and a drive-controller (18) therein. The cross bar (16)includes a vertical wall (16*a*) extending upwards in the upper central portion and a recess (16*b*) for holding a movable iron core (described below) at the bottom surface. The cross bar is held and guided by the inner wall of the base so as to be vertically movable. The vertical wall (16*a*) is provided with an opening (16*c*) in which a movable contact (20) is placed to be vertically movable but incapable of horizontal movement. A movable contact supporter (22) is placed on the upper surface of the movable contact (20) and a movable contact point (24) is attached at the lower surface of both ends of the movable contact (20) extending from the opening (16*c*). A spring supporter (25) having a channel shape is provided such a manner that the upper end is engaged with the movable contact supporter and the lower end supports a contactor spring (28). The contact spring (28) is compressed between the stopper (26) projecting from the cross bar (16) and the spring supporter (25) whereby the upper surface of the movable contact supporter (22) and the upper side (25*a*) of the spring supporter (25) as well as the upper surface of the movable contact (20) and the lower surface of the contact supporter (22) are assembled in a close contact state by the compressive force of the contact spring (28). The movable iron core (30) formed, by example, by piling silicon steel plate is fixed through an elastic plate (32) on the recess (16*b*) formed in the bottom surface of the cross bar (16) by pins (34).

On the other hand, the drive-controller (18) includes a stationary iron core (36) and a coil holder (38). The stationary iron core is formed, for example, by piling silicon steel plates and pins (40) are horizontally passed through the stationary iron core. A fixed shock-absorbing part (42) is fitted to each projection (40*a*) of the pins and a guide member (44) is fitted to the fixed shock-absorbing part (42). A fixed shock absorbing spring plate (45) is attached to the bottom surface of the stationary iron core (36). The stationary iron core (36) is put in the through-holes (38*a*) of the coil holder (38) and an engaging piece (not shown) formed on the coil holder (38) is engaged with a hole (not shown) formed in the guide member (44) to connect the stationary iron core (36) and the coil holder (38) in one piece.

A terminal plate (46) is attached on the upper surface of the base (10) with a screw (48) and a channel-like stationary contact (50) is attached on the upper surface of the terminal plate (46) with a screw (52). A stationary contact point (54) is fixed to the upper surface of the stationary contact (50) so as to face the movable contact point (24). An arc runner (56) is also attached to the terminal plate (46) with a screw (58). A rail plate (60) is attached on the lower surface of the base (10) with a screw (not shown). The rail plate (60) is provided with rail portion (60*a*) of a channel shape in cross section at both sides of the plate and the guide member (44) is inserted into the rail portion (60*a*) from the arrow mark direction A in FIG. 1 to prevent the movement of the drive-controller (18) in the vertical direction. After the drive-controller (18) is assembled to the rail plate (60), the rail plate (60) is secured to the bottom surface of the base, thus the stationary iron core (36) is disposed facing the movable iron core (30).

On the outer side surface of the coil holder (38), a ratchet (66) is placed and a compression spring (64) normally urges the ratchet downwards to allow it to move vertically. A pawl (66*a*) is formed on the ratchet (66) to engage with the engaging hole (60*b*) of the rail plate (60) so as to restrict the relative movement of the stationary iron core (36) and the coil holder (38) in the arrow mark direction A and vice versa in FIG. 1.

The arc box (12) made of a heat resistant material is fixed to the upper surface of the base (10) by a fastening bolt (68) and a grid (70) and a commutation plate (72) for arc extinction made of a magnetic metal are provided for each pole of R, S and T. Insulation barriers (74) are fixed to the outer side surface of the base (10) to separate the terminal plate (46) for each pole of R, S and T.

A plurality of fitting holes (14*a*) are formed in the outer periphery of the fitting plate (14) to fix it on a control panel, the fitting plate being attached to the bottom of the rail plate (60) with screws.

A trip spring (76)is placed between the rail plate (60) and the cross bar (16) in a compressed state to normally urge the cross bar (16) in the upward direction whereby the movable contact point (24) and the stationary contact point (54) are in an opening state.

The operation of the electromagnetic contactor having the structure will be described.

When a driving voltage is applied to the coil (78) as a magnetic flux producer which is held by the coil holder (38), an electromagnetic attractive force is produced by magnetic flux between the movable iron core (30) and the stationary iron core (36) to move the cross bar (16) connected to the movable iron core (30) downwards against the trip spring (76) whereby the movable contact (20) is brought into contact with the stationary contact (50) to form an electric circuit. Since the iron core gap $G_2$ formed between the movable iron core (30) and the stationary iron core (36) is made greater than the contact gap $G_1$ formed between the movable contact point (24) and the stationary contact point (54), the cross bar (16) is further depressed beyond the contacting position of the contacts until both the iron cores come into contact each other. The contact spring (28) is, therefore, deformed by compression force and the pressure of the spring is transmitted through the spring supporter (25) and the movable contact supporter (22) to the movable contact (20), thus the terminal plates (46), (46) are electrically connected under predetermined contacting pressure.

When the driving voltage applied to the coil (78) disappears, the electromagnetic attracting force acting between the movable iron core (30) and the stationary iron core (36) also disappears and the cross bar (16) is moved upwards by the urging force of the compressed trip spring (76) whereby the movable contact point (24) and the stationary contact point (54) are opened to open the electric circuit. At that moment, arc is produced between the movable contact point (24) and the stationary contact point (54). The arc is transferred from the movable contact point (24) to the commutation plate (72) and also is transferred from the stationary contact point (54) to the arc runner (56) respectively and thus separated arcs enter into gaps between the grids (70) by electromagnetic repulsive force caused by the inter action of arc current and contact current. Thus, the arc is cooled and separated for extinction.

As described above, the circuit formed between the terminal plates (46) and (46) is opened and closed by controlling application of the driving voltage to the coil (78).

In the conventional electromagnetic contactor, the distance (X) between the lower part (72*a*) of the commutation plate (72) and the arc runner (56) and the distance (Y) between the lower part (70*a*) of the grids (70) placed adjacent to the commutation plate (72) and the arc runner (56) had relation of $X>Y$ as shown in FIG. 3. Arc produced between the stationary contact point (54) and the movable contact point (24) at the breaking operation of the electromagnetic contactor is separated by electromagnetic force caused by current passing through the movable and stationary contacts (20), (50): one is commutated from the movable contact point (24) to the commutation plate (72) and the other is transferred from the stationary contact point (54) to the arc runner (56) to elongate positive column of the arc thus breaking of current is performed by pulling the arc between the grids (70). Since there was the relation of $X>Y$ in the distance as described above, the elongated arcs on the commutation (72) and the arc runner (56) is contrary shortened to stick on the commutation plate (72), the grids (70) and the arc runner (56) whereby sometimes breaking can not be attained. Particularly, when breaking current is small, possibility of the fault is high because electromagnetic force caused by current passing through the movable and stationary contacts (20), (50) is small.

In the conventional electromagnetic contactor, the grid (70) has been attached to the arc box (12) such a manner that a pair of fitting pawls (70*c*) formed on the upper surface of the grid (70) are inserted into the slits (12*a*) formed in the arc box (12) to extend outside as shown in FIG. 4 and then each of the top is bent as shown in FIG. 5. Therefore, the top of the bent portion of the pawl (70*c*) comes to an adjacent grid whereby the creepage distance (1) between the adjacent projections is smaller than the creepage distance (L) of the adjacent grid to possibly cause flash over on the outer surface of the arc box.

SUMMARY OF THE INVENTION

It is an object of the present invention to overcome the disadvantage of the conventional device and to provide an electromagnetic contactor performing a stable breaking operation without causing the sticking of arc produced at the breaking time.

It is another object of the present invention to provide an electromagnetic contactor performing a stable breaking operation even though electromagnetic force for separating arc produced at the breaking time is weak.

It is another object of the present invention to provide an electromagnetic contactor which prevents occurrence of flash over on the outer surface of the arc box.

The foregoing and the other objects of the present invention have been attained by providing an electromagnetic contactor which comprises a stationary contact point fixed to a stationary contact, a movable contact point fixed to a movable contact to associate with the stationary contact point for switching operations, an arc box for arc extinction for receiving the stationary and movable contacts, a commutation plate fixed to the arc box to commutate arc produced between the stationary and movable contacts and grids placed adjacent to the commutation plate and each having fitting pawls to be inserted into slits formed in the arc box, the top end of said fitting pawls being bent at the portion projecting from the slit to fix the grid to the arc box, wherein the shortest distance X between the commutation plate and the arc runner and the shortest distance Y between the grid and the arc runner (56) have a relation of $X \leqq Y$.

In accordance with the present invention, an electromagnetic contactor has an arc box in which grids are fitted by inserting the fitting pawls of the grids into the slits of the arc box and bending the top end of each fitting pawl projecting from said slit, wherein a plurality of grooves are formed on the outer surface of the arc box in the direction perpendicular to the plane of the grids which have a pair of fitting pawls at positions different one another, and slits are formed so that the fitting pawls of one grid are inserted in the slits which are adjacent to another slit for receiving the fitting pawl of the adjacent grid, the top end of each fitting pawl being bent in said groove.

DETAILED DESCRIPTION OF THE PREFERRED EMBODIMENTS

Preferred embodiments of the present invention will be described with reference to drawings.

Figure 1:
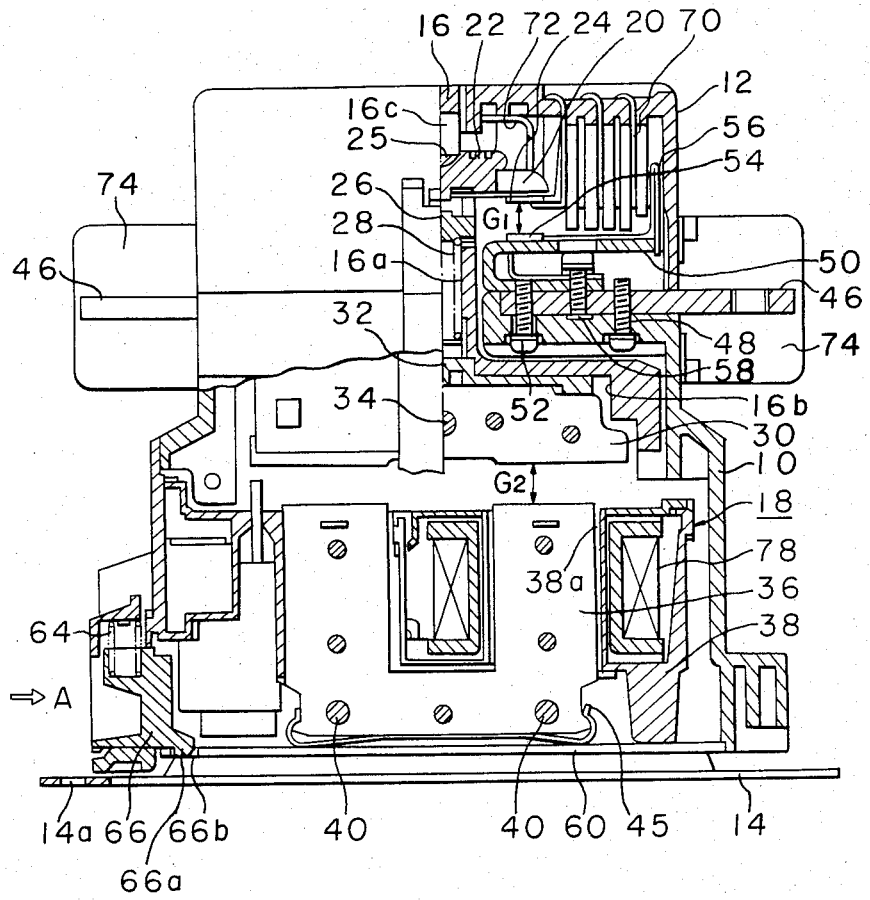
FIG. 1 is a front view partly cross sectioned of an electromagnetic contactor.
Figure 2:
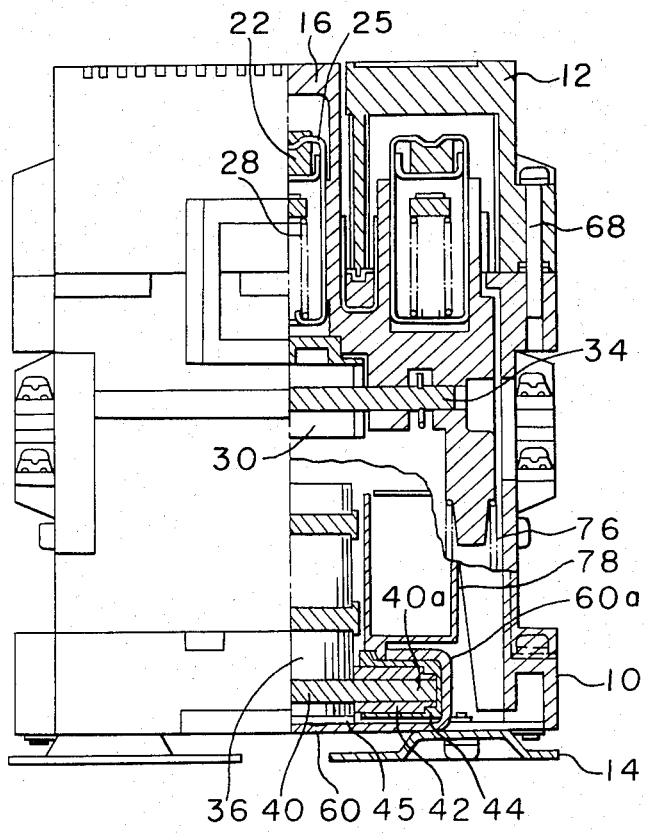
FIG. 2 is a side view partly cross sectioned of the electromagnetic contactor of FIG. 1.
Figure 3:
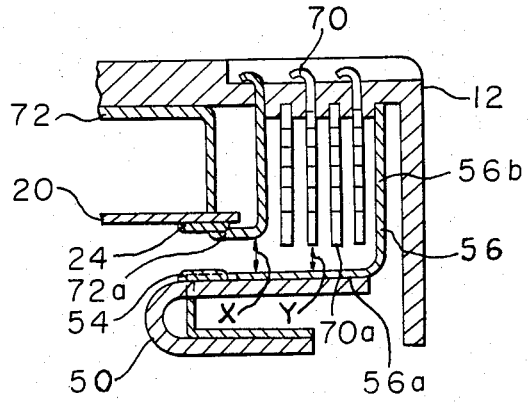
FIG. 3 is a schematic view in cross section of a part of an arc box of the conventional electromagnetic contactor.
Figure 4:
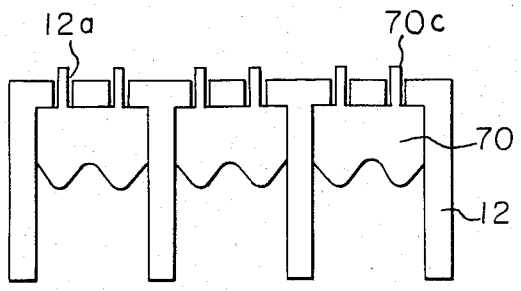
FIG. 4 is a front view in cross section of an arc box applied to the electromagnetic contactor.
Figure 5:
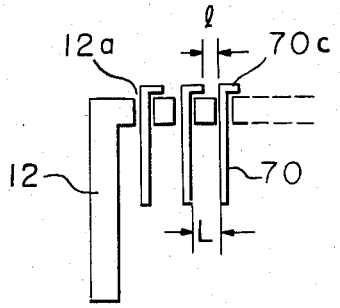
FIG. 5 is a side cross sectional view of the part of the arc box.
Figure 6:
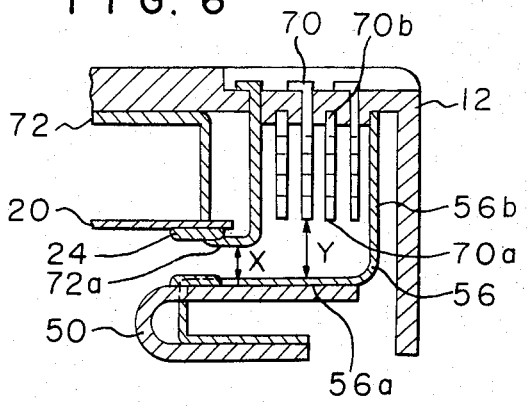
FIG. 6 is a front view of a grid of the present invention.

FIG. 6 illustrates an embodiment of the present invention. As it is clear from the FIG. 6, the commutation plate (72) is bent in a substantially U-shape and both the ends are fitted to the arc box (12). Assuming that the distance between the lower part (72*a*) of the commutation plate (72) and the arc runner (56) that is, the shortest distance between the commutation plate (72) and the arc runner (56) is given as (X) and the distance between the lower part (70*a*) of the grids (70) placed adjacent to the commutation plate (72) and the arc runner (56), that is, the shortest distance between the grids (70) and the arc runner (56) is given as (Y), the contactor of this embodiment is made to satisfy relationship of the distances as X<Y. The other ends (70*b*) of the grids (70) are fixed to the arc box (12).

The operation of the electromagnetic contactor will be described.

When a driving voltage is applied to a drive-controlling unit (38), electromagnetic attracting force is produced between the movable iron core (30) and the stationary iron core (36) by magnetic flux produced by the control-driving unit (38) and the cross bar (16) connected to the movable iron core (30) moves downwards against the trip spring (76) to make the movable contact (24) contact with the stationary contact (54). Since the iron core gap formed between the movable iron core (30) and the stationary iron core (36) is made greater than the contact gap formed between the movable contact (24) and the stationary contact (54), the cross bar (16) is further depressed beyond the contacting position of the contacts until both the iron cores come into contact each other. This causes a compressive deformation of the contact spring (28) and the spring force is transmitted through the spring supporter (25) and the movable contact supporter (20) to the movable contact (24), thus the terminal (46) is electrically connected to the other teminal (46) placed opposite the former to form the same electric path under predetermined contacting pressure.

When the driving voltage applied to the drive-controlling unit (38) disappears, electromagnetic attracting force acting between the movable iron core (30) and the stationary iron core (36) also disappears and the cross bar (16) is moved upwards by repulsive force of the trip spring (76) which has been compressed thereby opening the contacts. At that moment, arc is produced between the movable contact (24) and the stationary contact (54). The arc is transferred from the movable contact (24) to the commutation plate (72) and from the stationary contact (50) to the arc runner (56) respectively and the separated arcs enter into gaps between the grids by electromagnetic repulsive force caused by the inter action of arc current and contact current. Thus, the arc is cooled and separated for extinction.

As described above, the circuit formed between the terminal plates (46), (46) is opened and closed by controlling application of the driving voltage to the drive-controlling unit (38).

In accordance with the present invention, the shortest distance X between the arc runner (56) and the commutation plate (72) and the shortest distance Y between the arc runner (56) and the grid (70) have relation of X<Y. A stable breaking operation can, therefore, be obtained without causing the sticking of arc even though electromagnetic force acting to arc produced at breaking time is weak. The same effect is obtained by giving relation of X=Y wherein X and Y are defined above.

Figure 7:
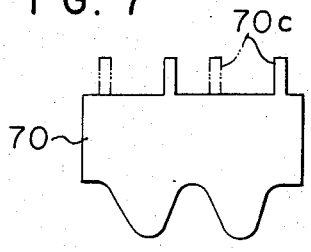
FIG. 7 is a front view of a grid applied to the present invention.
Figure 8:
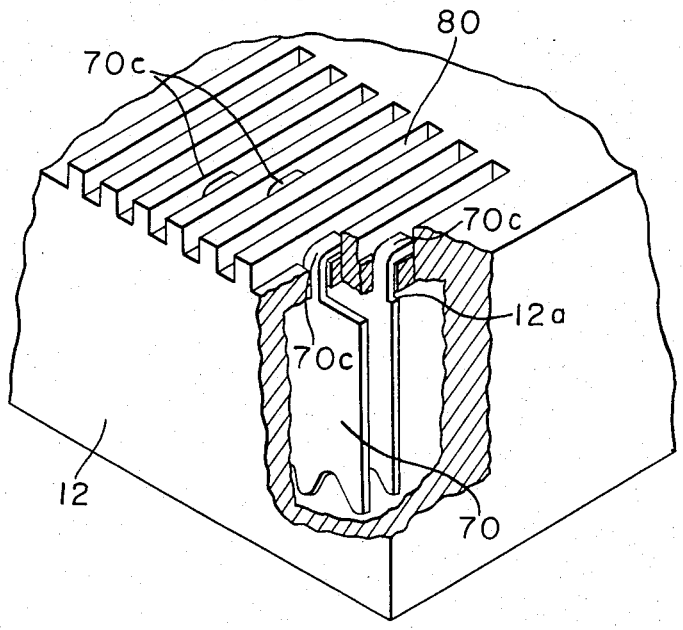
FIG. 8 is a perspective view partly removed of the arc box in which the grids are fitting.

FIG. 7 is a front view of a grid of the present invention and FIG. 8 is a perspective view, partially removed for showing how the grids are fitted in the arc box of the present invention. A pair of fitting pawls (70*a*) are formed on the grid (70) in an asymmetric positions (one pair are shown in the solid line and the other in the broken line).

In other words, the fitting pawls formed on the different grid are matched when one of the grid is reversed.

On the other hand, a plurality of grooves (80) are formed side by side on the outer surface of the arc box (12) in the direction perpendicular to the plane of the grids (70) and a plurality of slits (12*a*)are formed in the bottoms of each grooves.

With the structure of the present invention, the grids (70) are fitted to the arc box (12) by alternately reversing the grids whereby the fitting pawls (70*a*) of the adjacent grids (70) are respectively inserted into the slits (12*a*) of the adjacent grooves (80) and then the fitting pawls (70*a*) are bent in the grooves (80).

It is possible to prepare two kinds of grids on which the fitting pawls are formed in different positions so that the grids are alternately fitted in the arc box (12).

As described above, in accordance with the embodiment of the present invention, the fitting pawls of grid adjacent one another are inserted into separate grooves and are fitted in the grooves by bending them whereby the creepage distance the top of the fitting pawls bent and the adjacent grid is prolonged to effectively prevent flash over on the outer surface of the arc box.

We claim:

1. An electromagnetic contactor which comprises:

(a) a stationary contact point fixed to a stationary contact;

(b) a movable contact point fixed to a movable contact, said movable contact point being positioned to associate with said stationary contact point for switching operations and being movable in a contact direction toward and away from said stationary contact;

(c) an arc box for arc extinction, one face of said arc box having a plurality of parallel, regularly spaced slits therein extending in a slit-extending direction perpendicular to said contact direction;

(d) a grid composed of a plurality of parallel planar grid plates disposed in said arc box, said plurality of planar grid plates extending toward said stationary contact in said contact direction and extending perpendicularly thereto in said slit-extending direction, the ends of said grid plates closest to said stationary contact being spaced therefrom by a distance Y measured by the shortest unobstructed distance, each of said planar grid plates terminating in a plurality of fitting pawls each of which extends through a corresponding one of said slits in said one face of said arc box, the portions of said fitting pawls which extend through said slits being bent over in a pawl-extending direction perpendicular to both said contact direction and said slit-extending direction to fix said grid plates to said arc box;

(e) a commutation plate in electrical contact with said movable contact and with said arc box to commutate arc produced between said stationary contact and said movable contact, the end of said commutation plate closet to said stationary contact being spaced therefrom by a distance X measured by the shortest unobstructed distance, the distance X being smaller than or equal to the distance Y; and (f) an arc runner in electrical contact with said stationary contact and with said arc box.

2. An electromagnetic contactor according to claim 1 wherein a plurality of grids and commutation plates are provided depending on number of phase of electrical path formed by said stationary contact and said movable contact.

3. An electromagnetic contactor according to claim 1 wherein said grid and said commutation plate are made of magnetic metal.

4. An electromagnetic contactor according to claim 1 wherein said arc box is made of a heat resistant material.

5. An electromagnetic contactor according to claim 1 wherein:

(a) a plurality of parallel, regularly spaced grooves are formed in said one face of said arc box, said grooves extending in said pawl-extending direction;

(b) said plurality of parallel slits are formed in the bottom of said parallel grooves and extend perpendicularly to said parallel grooves; and (c) the portions of said fitting pawls which extend through said slits are bent over into and wholly contained within said grooves.

6. An electromagnetic contactor according to claim 5 wherein each of said planar grid plates has a pair of said fitting pawls at positions different from one another and said slits are formed so that the pair of fitting pawls on one of said grid plates are inserted in slits which are adjacent to the slits which receive the pair of fitting pawls on the adjacent grid plate.

7. An electromagnetic contactor according to claim 10 wherein the fitting pawls on said one of said grid plates are formed in asymetrical positions with reference to the fitting pawls on said adjacent grid plate.

8. An electromagnetic contact which comprises a stationary contact point fixed to a stationary contact, a movable contact point fixed to a movable contact to associate with the stationary contact point for switching operations, an arc box for arc extinction for receiving said stationary and movable contacts, a commutation plate which is fixed to said arc box to commutate a portion of arc near said movable contact point, said arc being produced between said stationary and movable contacts and which has a bent portion by which at the initial stage of commutation, arc is led in the direction perpendicular to the direction of the opening of said contact points and subsequently is led to the direction in parallel to the direction of the opening, an arc runner which is fixed to said arc box to commutate a portion of said arc near said stationary contact point and forms a space for arc in association with said commutation plate and which has a bent portion by which at the initial stage of commutation, arc is led in the direction perpendicular to the direction of the opening of said contact points and subsequently is led in the direction parallel to the direction of the opening and grids which are fixedly positioned in said arc box to be arranged between said commutation plate and said arc runner, wherein the shortest distance X between said commutation plate and said arc runner and the shortest distance Y between said grid and said arc runner have relation of $X \leqq Y$.

9. An electromagnetic contactor according to claim 8 wherein the shortest distance X is a distance between the surface of said commutation plate and said arc runner on which said arc are led in the direction perpendicular to the direction of the opening of said stationary and movable contact points and the shortest distance Y is a distance between the lower end of the grids and the surface of said arc runner on which said arc is led in the direction perpendicular to the direction of the opening of said contact points.

10. An electromagnetic contactor according to claim 8 wherein a plurality of grids, arc runners and commutation plates are provided depending on number of phase of electrical path formed by said stationary contact and said movable contact.

11. An electromagnetic contactor according to claim 9 wherein said grids, arc runners and commutation plates are made of magnetic metal.

12. An electromagnetic contactor according to claim 10 wherein said arc box is made of a heat resistant material.

13. An electromagnetic contactor which comprises a stationary contact point fixed to a stationary contact, a movable contact point fixed to a movable contact to associate with the stationary contact point for switching operations, an arc box for arc extinction for receiving said stationary and movable contacts, a commutation plate which is fixed to said arc box to commutate a portion of arc near said movable contact point, said arc being produced between said stationary and movable contacts and which has a bent portion by which at the initial stage of commutation, arc is led in the direction perpendicular to the direction of the opening of said contact points and subsequently is led to the direction in parallel to the direction of the opening, an arc runner which is fixed to said arc box to commutate a portion of said arc near said stationary contact point and forms a space for arc in association with said commutation plate and which has a bent portion by which at the initial stage of commutation, arc is led in the direction perpendicular to the direction of the opening of said contact points and subsequently is led in the direction parallel to the direction of the opening, and grids which are fixedly positioned in said arc box to be arranged between said commutation plate and said arc runner and are placed fixedly in said arc box, wherein the shortest distance X between said commutation plate and said arc runner and the shortest distance Y between said grid and said arc runner have relation of $X \leqq Y$; a plurality of grooves are formed on the outer surface of said arc box in the direction perpendicular to the plane of said grids which have a pair of fitting pawls at positions different one another, and slits are formed so that the fitting pawls of one grid are inserted in the slits for bending which are adjacent to another slits for receiving the fitting pawls of the adjacent grid.

14. An electromagnetic contactor according to claim 13 wherein the fitting pawls of said grid are formed in asymmetrical position with reference to those of an adjoining grid.

15. An electromagnetic contactor which comprises a stationary contact point fixed to a stationary contact, a movable contact point fixed to a movable contact to associate with the stationary contact point for switching operations, an arc box for arc extinction for receiving said stationary and movable contacts, a commutation plate fixed to said arc box to commutate arc produced between said stationary and movable contacts and grids placed adjacent to said commutation plate and each having fitting pawls to be inserted into slits formed in said arc box, the top end of said fitting pawls being bent at the portion projecting from the slit to fix said grid to the arc box, wherein a plurality of grooves are formed on the outer surface of said arc box in the direction perpendicular to the plane of said grids which have a pair of fitting pawls at positions different one another, and slits are formed so that the fitting pawls of one grid are inserted in the slits for bending which are adjacent to another slit for receiving the fitting pawl of the adjacent grid.

* * * * *